US007705821B2

(12) United States Patent
Endo

(10) Patent No.: US 7,705,821 B2
(45) Date of Patent: Apr. 27, 2010

(54) DRIVING METHOD USING DIVIDED FRAME PERIOD

(75) Inventor: Masami Endo, Atsugi (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 830 days.

(21) Appl. No.: 11/275,615

(22) Filed: Jan. 19, 2006

(65) Prior Publication Data

US 2006/0170622 A1 Aug. 3, 2006

(30) Foreign Application Priority Data

Jan. 31, 2005 (JP) ..... 2005-024547

(51) Int. Cl.
*G09G 3/36* (2006.01)

(52) U.S. Cl. ..... 345/100; 345/536

(58) Field of Classification Search ..... 345/87, 345/98, 99, 536, 539, 545, 547, 100
See application file for complete search history.

(56) References Cited

U.S. PATENT DOCUMENTS

| | | | | |
|---|---|---|---|---|
| 4,862,269 | A | 8/1989 | Sonoda et al. | |
| 5,929,832 | A * | 7/1999 | Furukawa et al. | 345/98 |
| 5,990,629 | A | 11/1999 | Yamada et al. | |
| 6,025,822 | A | 2/2000 | Motegi et al. | |
| 6,222,515 | B1 | 4/2001 | Yamaguchi et al. | |
| 6,252,613 | B1 | 6/2001 | Borel et al. | |
| 6,307,565 | B1 * | 10/2001 | Quirk et al. | 345/554 |
| 6,611,108 | B2 | 8/2003 | Kimura | |
| 6,774,574 | B1 | 8/2004 | Koyama | |
| 6,777,887 | B2 | 8/2004 | Koyama | |
| 6,847,341 | B2 | 1/2005 | Kimura et al. | |
| 7,330,179 | B2 | 2/2008 | Endo et al. | |
| 2002/0024508 | A1 | 2/2002 | Nakamura et al. | |
| 2002/0109691 | A1 | 8/2002 | Champion | |
| 2002/0109693 | A1 * | 8/2002 | Champion et al. | 345/536 |
| 2003/0076282 | A1 | 4/2003 | Ikeda et al. | |
| 2003/0098875 | A1 | 5/2003 | Kurokawa et al. | |

(Continued)

FOREIGN PATENT DOCUMENTS

CN 1551082 12/2004

(Continued)

OTHER PUBLICATIONS

Office Action (Chinese Patent Application No. 200610002428.5) mailed Jun. 6, 2008 with full English translation, 18 pages.

*Primary Examiner*—Chanh Nguyen
*Assistant Examiner*—Kwang-Su Yang
(74) *Attorney, Agent, or Firm*—Fish & Richardson P.C.

(57) ABSTRACT

A driving method of a display device for performing time-division gray scale display is disclosed, which is capable of inputting accurate data into a panel by using one memory. M groups each having a pair of a first period and a second period are provided in one frame period. Video signals are written into a memory in the first period of at least one group among the m groups, while video signals are read out from the memory in the respective second periods of the m groups. The start timing of reading out video signals from the memory is synchronized with the start timing of each of the n sub-frame periods.

18 Claims, 11 Drawing Sheets

U.S. PATENT DOCUMENTS

| | | | | |
|---|---|---|---|---|
| 2003/0103025 | A1 | 6/2003 | Kurokawa et al. | |
| 2003/0174153 | A1 | 9/2003 | Koyama | |
| 2003/0222880 | A1 | 12/2003 | Waterman | |
| 2004/0090404 | A1* | 5/2004 | Endo et al. | 345/82 |
| 2004/0095356 | A1* | 5/2004 | Inoue et al. | 345/531 |
| 2004/0207331 | A1 | 10/2004 | Koyama | |
| 2004/0227764 | A1 | 11/2004 | Endo | |
| 2005/0270254 | A1 | 12/2005 | Ozaki | |

FOREIGN PATENT DOCUMENTS

| | | | |
|---|---|---|---|
| EP | 1 063 630 | A2 | 12/2000 |
| EP | 1 094 438 | | 4/2001 |
| JP | 04-291395 | | 10/1992 |
| JP | 2001-005426 | | 1/2001 |
| WO | 98/33165 | | 7/1998 |
| WO | 98/43154 | | 10/1998 |
| WO | 2004/036534 | | 4/2004 |

* cited by examiner

DRIVING METHOD USING DIVIDED FRAME PERIOD

BACKGROUND OF THE INVENTION

1. Field of the Invention

The present invention relates to a driving method of an active matrix display device, which has a switching element in each pixel and a memory for storing a video signal inputted to each pixel. In particular, the invention relates to a driving method of a display device where gray scales are expressed by controlling the light-emission period of each pixel.

2. Description of the Related Art

As a driving method of a display device, such a driving method of a display device has been proposed that gray scales are expressed by dividing one frame period into multiple sub-frame periods and selecting light emission or non-light emission of each pixel by inputting a video signal thereto in each sub-frame period (hereinafter also referred to as a time-division gray scale display) (see Patent Document 1).

For example, one frame period is divided into first to third sub-frame periods, and the ratio of the (light-emission length of the first sub-frame period): (light-emission length of the second sub-frame period):(light-emission length of the third sub-frame period) is set to satisfy $2^0:2^1:2^2$. Here, the light-emission length of each sub-frame period corresponds to a period in which a pixel selected for light emission emits light in each sub-frame period. By inputting a video signal into each pixel in each of the first to third sub-frame periods to select light emission or non-light emission of the pixel, 8 gray scales can be expressed.

A display device that performs time-division gray scale display has a panel including multiple pixels and a driver circuit for inputting video signals into the multiple pixels, and a peripheral circuit for inputting signals into the panel. The peripheral circuit generates video signals and timing signals to be inputted into the panel. Based on the signals inputted from the peripheral circuit, the panel performs the time-division gray scale display.

The peripheral circuit of the display device that performs time-division gray scale display has a memory and a controller for controlling the memory. The controller writes (stores) video signals (hereinafter also referred to as source video signals) inputted to the display device into the memory, and reads out the written (stored) video signals to be inputted into the panel. In order to perform time-division gray scale display, it is necessary that video signals are read out from the memory in each sub-frame period. That is, the read operation of video signals from a memory is required to be synchronous with each sub-frame period. On the other hand, source video signals are inputted into the display device independently of the sub-frame periods. That is, the write operation of source video signals into the memory is asynchronous with each sub-frame period.

[Patent Document 1]

Japanese Patent Laid-Open No. 2001-5426

In a peripheral circuit of a display device that performs time-division gray scale display, the write timing of source video signals into a memory is asynchronous with the read timing of video signals from the memory. Therefore, such a method has been adopted that two memories (single-port memories) are provided in the peripheral circuit so that a video signal stored in one memory is read out while a source video signal is written into the other memory. This method requires two memories and a circuit for controlling the write/read operation of video signals to/from the two memories in the peripheral circuit, which results in the complex configuration of the peripheral circuit and larger size of the display device.

Alternatively, there is a method of using one dual-port memory instead of providing two memories in the peripheral circuit. In the dual-port memory, the write operation of source video signals and the read operation of video signals can be performed independently of each other. That is, the read operation of video signals that are written into a dual-port memory can be performed concurrently with the write operation of source video signals into the dual-port memory. However, since the same memory area is used for writing source video signals and reading out video signals in concurrently performing the write operation of source video signals and the read operation of video signals to/from the dual-port memory, signals written into the memory and signals read out from the memory are mixed with each other. Therefore, there is a problem in that video signals cannot be accurately inputted into the panel, which results in the low display quality of images.

SUMMARY OF THE INVENTION

In view of the foregoing, the invention provides a driving method of a display device that performs time-division gray scale display, where the peripheral circuit configuration is simplified by using one memory to downsize the display device, and accurate data can be inputted into a panel to perform favorable image display.

In a driving method of a display device that has a memory, a controller for controlling the write/read operation of video signals to/from the memory, and a panel having multiple pixels for receiving video signals read out from the memory, one frame period is divided into n (n is a natural number not less than 2) sub-frame periods; and the light-emission state of each of the multiple pixels is selected in each of the n sub-frame periods. Specifically, the following methods are adopted.

M (m is a natural number not less than n) groups each having a pair of a first period and a second period are provided in one frame period. The controller writes video signals into the memory in the first period of at least one group among the m groups, and reads out video signals from the memory in the respective second periods of the m groups. The start timing of reading out video signals from the memory is synchronized with the start timing of each of the n sub-frame periods.

In the aforementioned method, video signals may be read out from the memory not in the respective second periods of the m groups, but in the second periods of the n groups.

In one frame period, the number of read operations of video signals from the memory is set larger than the number of write operations of video signals into the memory.

The memory has a first memory area and a second memory area. In an i-th (i is a natural number) frame period, video signals are written into the first memory area while video signals stored in the second memory area are read out. In an (i+1)-th frame period that is right after the i-th frame period, video signals are written into the second memory area while video signals stored in the first memory area are read out. In an (i+2)-th frame period that is right after the (i+1)-th frame period, video signals are written into the first memory area while video signals stored in the second memory area are read out.

Note that each of the first memory area and the second memory area has a memory capacity to store video signals corresponding to the multiple pixels.

The second period may be longer than the first period. In addition, the memory may be an SRAM.

Since the write operation and the read operation of video signals to/from the memory are separately performed in the first period and the second period, only one memory is required, and signals written into the memory and signals read out from the memory are not to be mixed with each other. In addition, since multiple groups each having a pair of the first period and the second period are provided in one frame period to selectively write video signals into the memory, the number of the read operations of video signals from the memory can be larger than the number of the write operations of video signals into the memory. In this manner, even if the write timing of source video signals into the memory is asynchronous with each sub-frame period, the read timing of video signals from the memory can be synchronized with the sub-frame period, thereby time-division gray scale display can be performed.

As set forth above, a driving method of a display device that performs time-division gray scale display can be provided, where the peripheral circuit configuration is simplified by using one memory to downsize the display device, and accurate data can be inputted into a panel to perform favorable image display.

DETAILED DESCRIPTION OF THE INVENTION

Although the invention will be fully described by way of embodiment modes and embodiments with reference to the accompanying drawings, it is to be understood that various changes and modifications will be apparent to those skilled in the art. Therefore, unless otherwise such changes and modifications depart from the scope of the invention, they should be construed as being included therein.

Embodiment Mode 1

Figure 1:
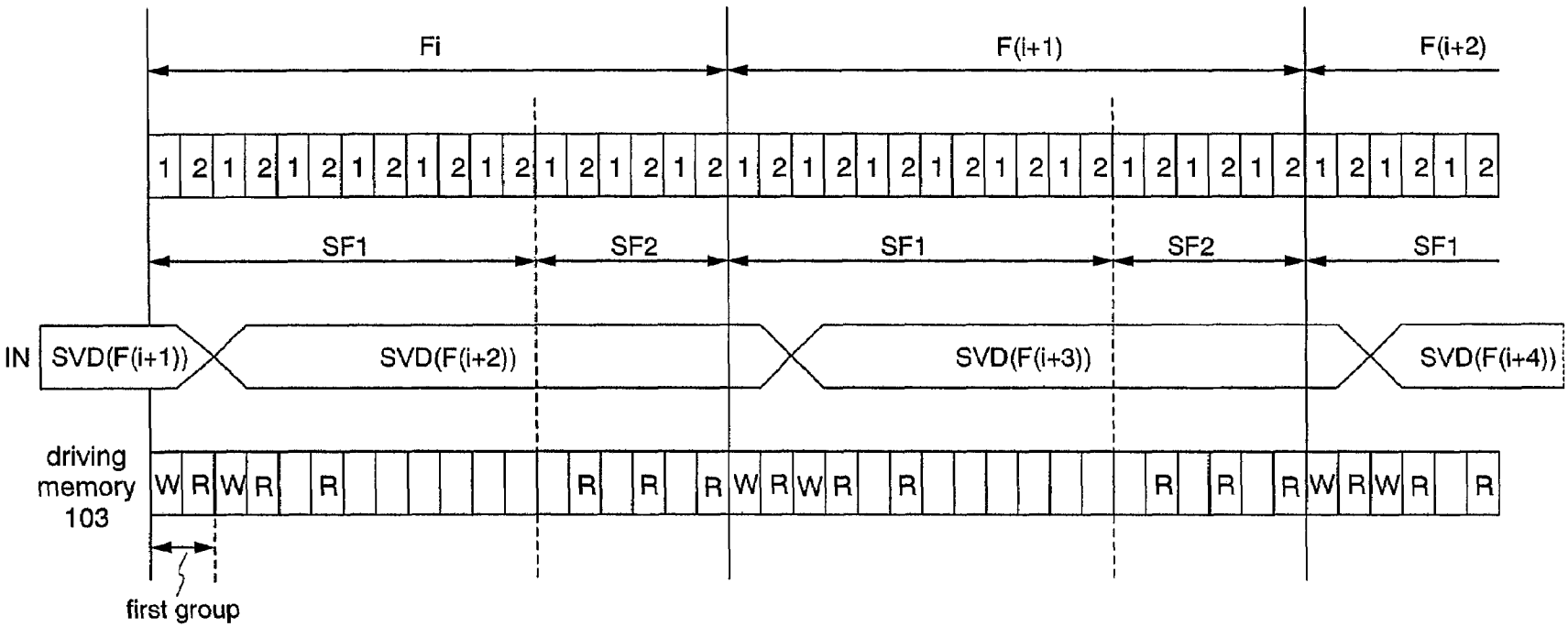
FIG. 1 illustrates Embodiment Mode 1.
Figure 2A:
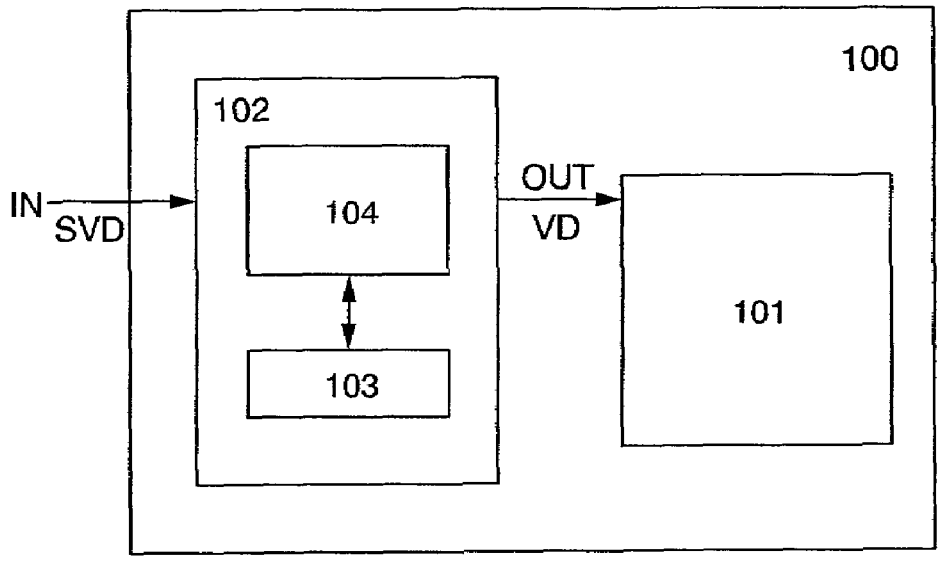
FIGS. 2A and 2B illustrate Embodiment Mode 1.
Figure 2B:
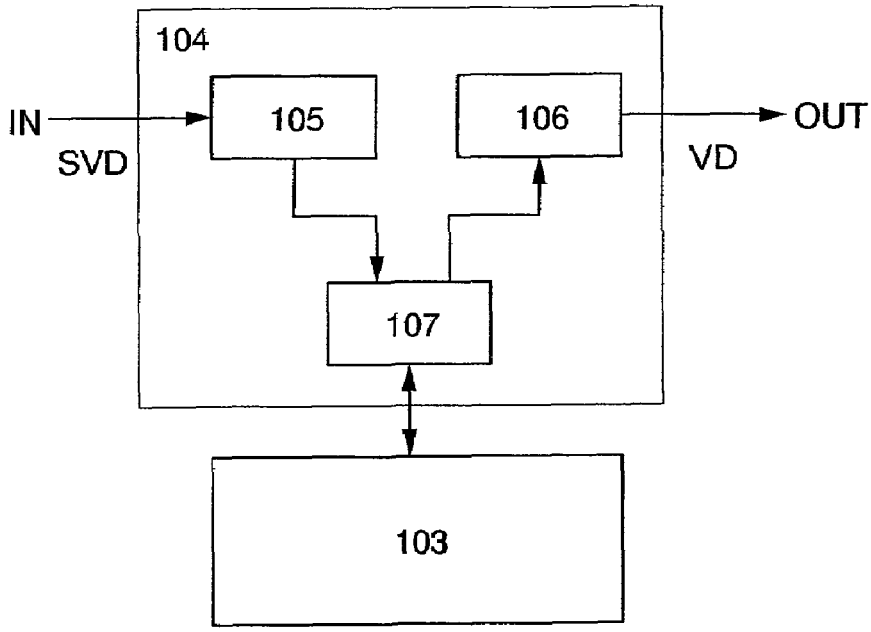

Description is made on Embodiment Mode 1 with reference to FIGS. 1, 2A and 2B. FIG. 1 is a timing chart showing the driving method of a display device. FIGS. 2A and 2B illustrate configurations of a display device using the driving method shown in the timing chart in FIG. 1.

In FIG. 2A, a display device 100 includes a panel 101 and a peripheral circuit 102. The peripheral circuit 102 includes a controller 104 and a memory 103. A source video signal SVD inputted to the display device is inputted to the peripheral circuit 102 (indicated by "IN" in FIG. 2A). The source video signal SVD inputted to the peripheral circuit 102 is written to the memory 103 by the controller 104. The video signal written to the memory 103 is read out by the controller 104 and outputted from the peripheral circuit 102 as a video signal VD (indicated by "OUT" in FIG. 2A). The video signal VD is inputted to the panel 101. The panel 101 performs image display by using the video signal VD.

FIG. 2B is a diagram showing a specific configuration of the controller 104 in FIG. 2A. In FIG. 2B, the controller 104 includes a write-in memory 105, a readout memory 106 and a selector 107. Source video signals SVD are continuously inputted to the peripheral circuit 102 (indicated by "IN" in FIG. 2B). Among the source video signal SVD, those inputted to the peripheral circuit 102 in a predetermined period are stored in the write-in memory 105 by the controller 104. The selector 107 selects the writing or reading of signals to/from the memory 103 through a bus which connects the selector 107 and the memory 103. When the signal writing to the memory 103 is selected by the selector 107, video signals stored in the write-in memory 105 are written to the memory 103 through the bus. On the other hand, when the signal reading from the memory 103 is selected by the selector 107, signals written into the memory 103 are partially read out through the bus, and then temporarily stored in the readout memory 106. The thusly stored video signals are outputted from the peripheral circuit 102 as video signals VD (indicated by "OUT" in FIG. 2B).

The timing chart in FIG. 1 shows the driving method of a display device having the configuration in FIG. 2, which focuses on the driving method of the memory, in particular. The driving method of the memory 103 is expressed in terms of the relationship between frame periods, sub-frame periods and source video signals SVD. The driving method of a display device of the invention is described with reference to FIG. 1. Note that reference numerals in FIG. 2 are used for description.

Driving the memory 103 means that video signals are written from the write-in memory 105 and video signals are read out into the readout memory 106. The state in which video signals are written into the memory 103 is indicated by "W", while the state in which video signals are read out from the memory 103 is indicated by "R".

Frame periods are denoted by Fi (i is a natural number), F(i+1) and F(i+2). Each of the frame periods Fi, F(i+1) and F(i+2) corresponds to one frame period, in which one image is displayed. F (i+1) is the frame period right after the Fi, and F (i+2) is the frame period right after the F(i+1). Sub-frame periods are denoted by SF. In the timing chart of FIG. 1, one frame period has two sub-frame periods: SF1 and SF2.

A source video signal SVD inputted to the controller 104 is indicated by IN. A source video signal SVD corresponding to a video signal VD that is displayed in the frame period F(i+1) is indicated by SVD(F(i+1)). A source video signal SVD corresponding to a video signal VD that is displayed in the frame period F(i+2) is indicated by SVD(F(i+2)). A source video signal SVD corresponding to a video signal VD that is displayed in the frame period F(i+3) is indicated by SVD(F(i+3)). A source video signal SVD corresponding to a video signal VD that is displayed in the frame period F(i+4) is indicated by SVD(F(i+4)).

In each of the frame periods Fi, F(i+1) and F(i+2), multiple groups each having a pair of a first period and a second period are provided. In FIG. 1, the first period is indicated by "1" and the second period is indicated by "2".

Driving method of the memory 103 in the frame period Fi is described below.

First, operation in the sub-frame period SF1 is described. In the first period of the first pair (hereinafter referred to as a first group) of the sub-frame period SF1, video signals stored in the write-in memory 105 are written into the memory 103. Video signals to be written in the first period of the first group are inputted into the peripheral circuit 102 right before the first period, which correspond to a part of the source video signal SVD(F(i+1)) stored in the write-in memory 105. Then, in the second period of the first group, signals written into the memory 103 are partially read out and then stored in the readout memory 106. Video signals read out from the memory 103 in the second period of the first group are the video signals corresponding to the sub-frame period SF1 in the frame period Fi. The video signals stored in the readout memory 106 are outputted from the peripheral circuit 102 as video signals VD, and then inputted to the panel 101. In this manner, the panel 101 starts to display an image.

In the first period of the second group right after the first group, video signals stored in the write-in memory 105 are written into the memory 103. Video signals to be written in the first period of the second group are inputted into the peripheral circuit 102 right before the first period of the second group, namely during the period of the first group, which correspond to a part of the source video signal SVD(F(i+1)) stored in the write-in memory 105. In FIG. 1, the source video signals SVD(F(i+1)) are all written into the memory 103 in the first period of the first group and the first period of the second group. Subsequently, in the second period of the second group, signals written into the memory 103 are partially read out and then stored in the readout memory 106. The video signals read out from the memory 103 in the second period of the second group are the video signals corresponding to the sub-frame period SF1 in the frame period Fi. The video signals stored in the readout memory 106 are outputted from the peripheral circuit 102 as video signals VD, and then inputted to the panel 101.

In the first period of the third group right after the second group, video signals stored in the write-in memory 105 are not written into the memory 103. This is because all the source video signals SVD(F(i+1)) have already been written in the first period of the first group and the first period of the second group. In the second period of the third group, the signals written into the memory 103 are partially read out, and then stored in the readout memory 106. The video signals read out from the memory 103 in the second period of the third group are the video signals corresponding to the sub-frame period SF1 in the frame period Fi. The video signals stored in the readout memory 106 are outputted from the peripheral circuit 102 as video signals VD, and then inputted to the panel 101.

Through operations in the first to third groups, video signals corresponding to the sub-frame period SF1 are all read out from the memory 103, and thus inputted to the panel 101.

Description is made on the operation in the sub-frame period SF2. Since all the source video signals SVD(F(i+1)) are already written into the memory 103, the video signals stored in the write-in memory 105 are not written into the memory 103 in the first period of the first group in the sub-frame period SF2. In the second period of the first group, the video signals written into the memory 103 are partially read out, and then stored in the readout memory 106. Video signals read out from the memory 103 in the second period of the first group are the video signals corresponding to the sub-frame period SF2 in the frame period Fi. The video signals stored in the readout memory 106 are outputted from the peripheral circuit 102 as video signals VD, and then inputted to the panel 101.

Similar operation is repeated in the subsequent groups to the first group in the sub-frame period SF2. In this manner, the video signals corresponding to the sub-frame period SF2 are all read out from the memory 103, and thus inputted to the panel 101.

In this manner, by separately performing the write and read operations of video signals to/from the memory 103 in the first period and the second period, video signals can be read out from the memory 103 to be inputted into the panel 101 while the source video signals SVD(F(i+1)) can be written into the memory 103 in the frame period Fi. Even when only one memory 103 is provided, the signals written into the memory 103 and the signals read out from the memory 103 are not mixed. Furthermore, since the multiple first and second periods are provided in one frame period and the write operation of video signals into the memory 103 is selectively performed in the multiple first periods, the number of the read operations of video signals from the memory 103 can be larger than the number of the write operations of video signals into the memory 103. In this manner, even when the write timing of source video signals into the memory 103 is asynchronous with each sub-frame period, the read timing of video signals from the memory 103 can be synchronized with the sub-frame period, thereby time-division gray scale display can be performed.

In the frame periods other than the frame period Fi, the memory 103 is operated in a similar manner to the aforementioned driving method in the frame period Fi.

The timing chart of FIG. 1 shows the structure in which one frame period has two sub-frame periods SF1 and SF2. Note that the driving method of a display device of the invention is not limited to this, and can also be applied to the case where one frame period has n (n is a natural number not less than 2) sub-frame periods. In addition, given that one frame period has n sub-frame periods, the number of the groups each having the first period and the second period in one frame can be m (m is a natural number not less than n).

In the structure of FIG. 1, the write operation to the memory 103 is performed by using the two groups; however, the invention is not limited to this, and the write operation may be performed, for example, by using only one group or multiple groups in one frame period. In addition, in the structure of FIG. 1, the read operation of video signals from the memory 103 is separately performed by using three groups in each of the sub-frame periods SF1 and SF2; however, the invention is not limited to this. An arbitrary number of the read operations of video signals from the memory 103 can be performed in each sub-frame period. For example, video signals may be read out from the memory 103 in the second periods of all the groups. Furthermore, although the length of the first period and the second period in FIG. 1 is substantially the same, the invention is not limited to this, and the second period may be longer than the first period.

In the driving method of a display device of the invention, the number of the write operations of video signals into the memory 103 in one frame period, the number of the read operations of video signals from the memory 103 in one sub-frame period, the ratio of the length of the first period to that of the second period, and the like are optimized in accordance with the number of gray scales of an image, the number of sub-frames in one frame period, the memory capacity of the write-in memory 105, the memory capacity of the readout memory 106, the writing speed into the memory 103, the reading speed from the memory 103 and the like.

Embodiment Mode 2

Figure 3A:
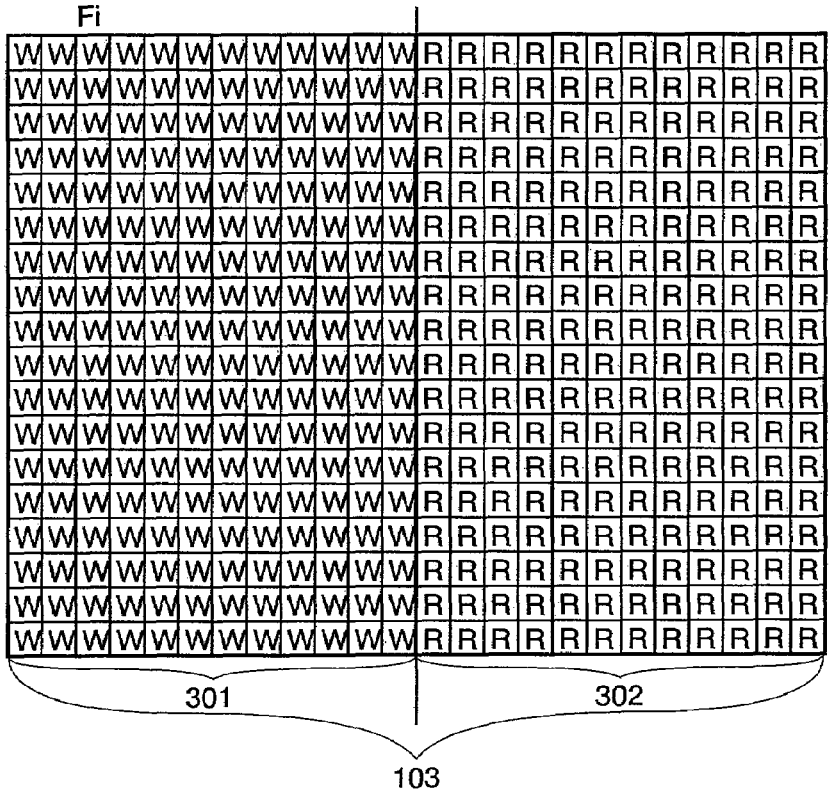
FIGS. 3A and 3B illustrate Embodiment Mode 2.
Figure 3B:
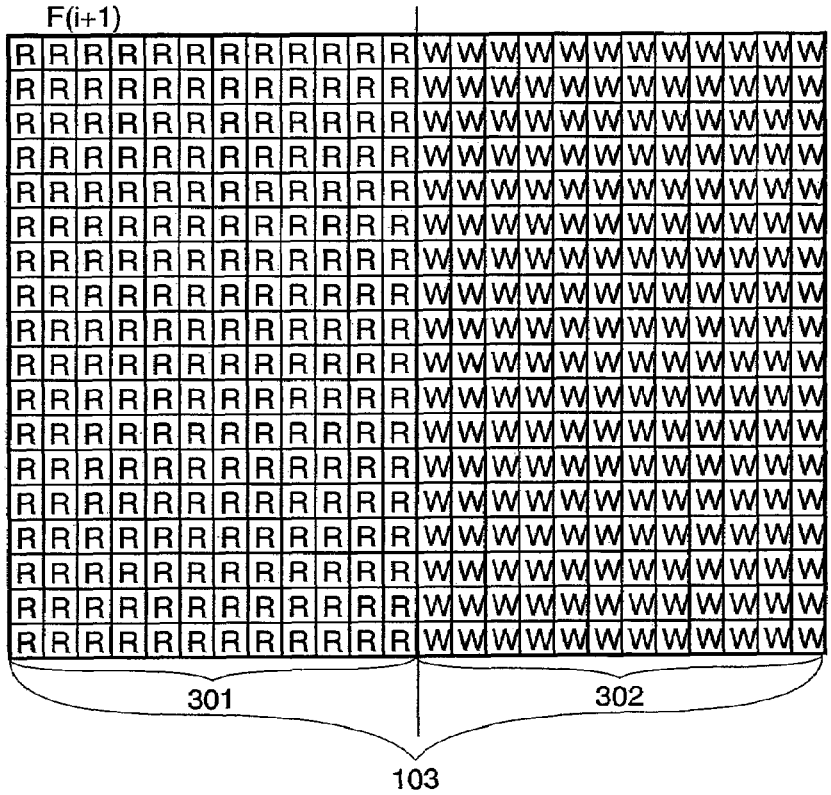
Figure 4:
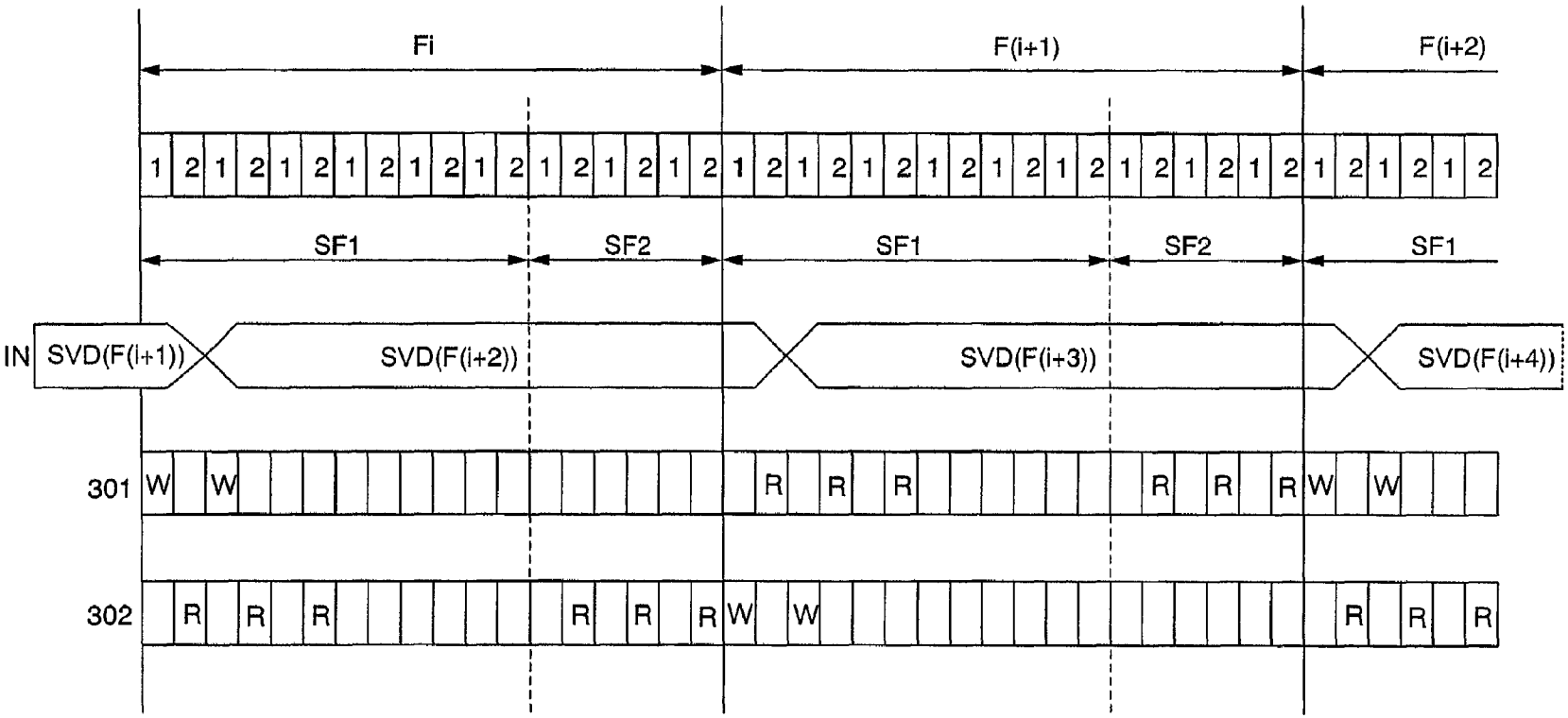
FIG. 4 illustrates Embodiment Mode 2.

Description is made on Embodiment Mode 2 with reference to FIGS. 3A, 3B and 4. FIGS. 3A and 3B show a more specific configuration of the memory 103 in the display device shown in FIG. 2, and the driven state of the memory 103 in each of the two consecutive frame periods Fi and F(i+1). FIG. 4 is a timing chart showing the driving method of the display device in the case of using the memory shown in FIGS. 3A and 3B as the memory 103 in FIG. 2. Note that common portions between FIG. 1 and FIG. 4 are denoted by common reference numerals, and the description thereon is omitted.

As shown in FIGS. 3A and 3B, the memory 103 has a first memory area 301 and a second memory area 302. Each of the first memory area 301 and the second memory area 302 has a memory capacity capable of storing video signals corresponding to the multiple of pixels in the panel 101.

In the frame period Fi, video signals are written into the first memory area 301 (indicated by "W" in FIG. 3A), while video signals stored in the second memory area 302 are read out (indicated by "R" in FIG. 3A). In the frame period F (i+1) right after the frame period Fi, video signals are written into the second memory area 302 (indicated by "W" in FIG. 3B), while video signals stored in the first memory area 301 are read out (indicated by "R" in FIG. 3B).

FIG. 4 shows the timing chart in the case of using the memory 103 having the configuration shown in FIGS. 3A and 3B. The memory area for writing video signals and the memory area for reading out video signals are switched alternately in each frame period.

In order to perform the driving method shown in FIG. 4, each of the multiple memory cells included in the memory 103 may be distinguished as a memory cell for writing a video signal or a memory cell for reading out a video signal by using the most significant address bit in each memory cell, and the most significant address bit can be changed in each frame period.

For example, in the frame period Fi, a signal of "0" is inputted to the most significant address bits of the memory cells corresponding to the first memory area 301 shown in FIG. 3A, while a signal of "1" is inputted to the most significant address bits of the memory cells corresponding to the second memory area 302. In the frame period F(i+1), a signal of "1" is inputted to the most significant address bits of the memory cells corresponding to the first memory area 301 shown in FIG. 3B, while a signal of "0" is inputted to the most significant address bits of the memory cells corresponding to the second memory area 302.

This embodiment mode can be appropriately implemented in combination with Embodiment Mode 1.

Embodiment Mode 3

Figure 5A:
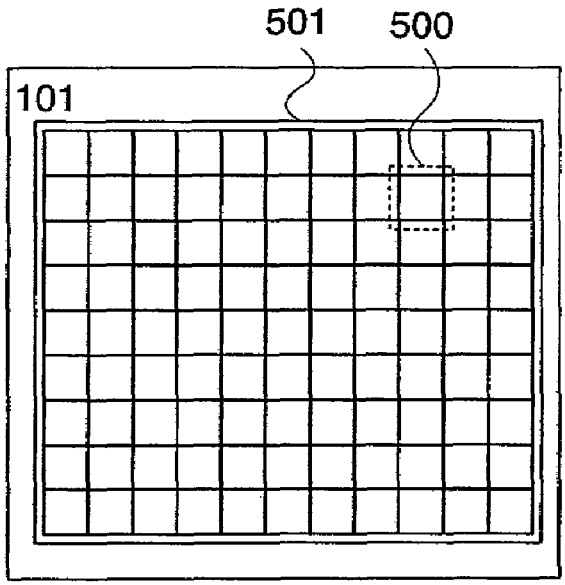
FIGS. 5A and 5B illustrate Embodiment Mode 3.
Figure 5B:
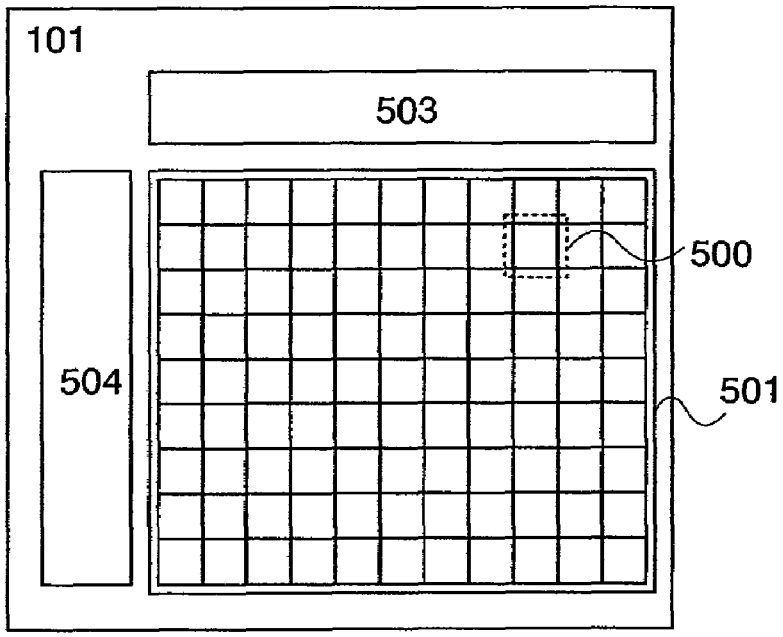

In Embodiment Mode 3, description is made on an example of the panel 101 in FIG. 2 with reference to FIGS. 5A and 5B. In FIG. 5A, the panel 101 has a pixel portion 501 including multiple pixels 500 arranged in matrix. The pixel portion 501 may have an active matrix arrangement where a switching element such as a thin film transistor is disposed in each pixel 500. As a display element of the pixel 500, a light-emitting element such as an electroluminescence element may be provided or a liquid crystal element may be provided.

Note that driver circuits for driving the pixel portion 501 may be provided over the same substrate as the pixel portion 501 as shown in FIG. 5B. Note that common portions between FIGS. 5A and 5B are denoted by common reference numerals, and the description thereon is omitted. In FIG. 5B, a first driver circuit 503 and a second driver circuit 504 are shown as the driver circuits. Note that the invention is not limited to this, and another driver circuit may be provided in addition to the first driver circuit 503 and the second driver circuit 504. The driver circuits may be formed over another substrate, and mounted onto the substrate where the pixel portion 501 is formed. In addition, the driver circuits may be formed over the same substrate as the pixel portion 501 by using thin film transistors that are formed through the same steps as the thin film transistors included in the pixels 500. A channel formation region of the thin film transistor may be formed of either a polycrystalline semiconductor or an amorphous semiconductor.

This embodiment mode may be appropriately implemented in combination with any of Embodiment Mode 1 and Embodiment Mode 2.

Embodiment Mode 4

Figure 6A:
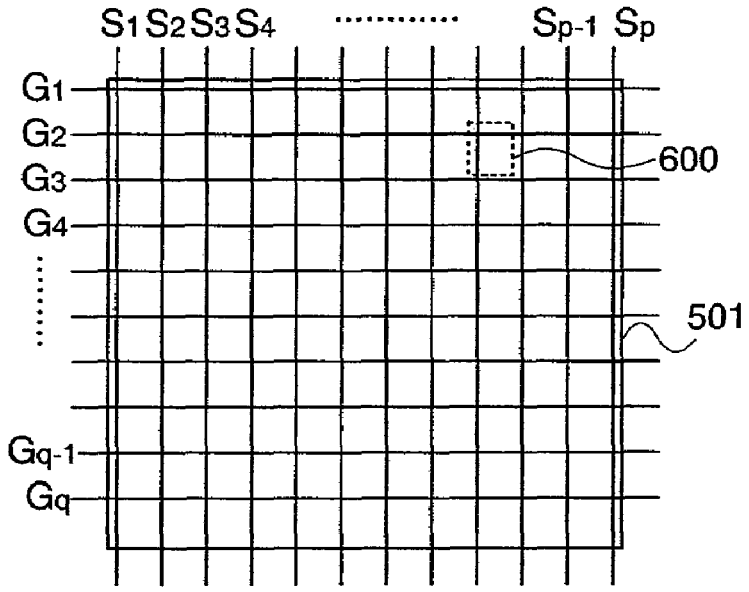
FIGS. 6A and 6B illustrate Embodiment Mode 4.

FIG. 6A shows a configuration example (hereinafter referred to as a first configuration) of the pixel portion 501 shown in FIGS. 5A and 5B. The pixel portion 501 has multiple first signal lines $S_1$ to $S_p$ (p is a natural number), multiple second signal lines $G_1$ to $G_q$(q is a natural number) that are provided to intersect the multiple first signal lines $S_1$ to $S_p$, and a pixel 600 provided at each intersection of the first signal lines $S_1$ to $S_p$ and the second signal lines $G_1$ to $G_q$.

Figure 6B:
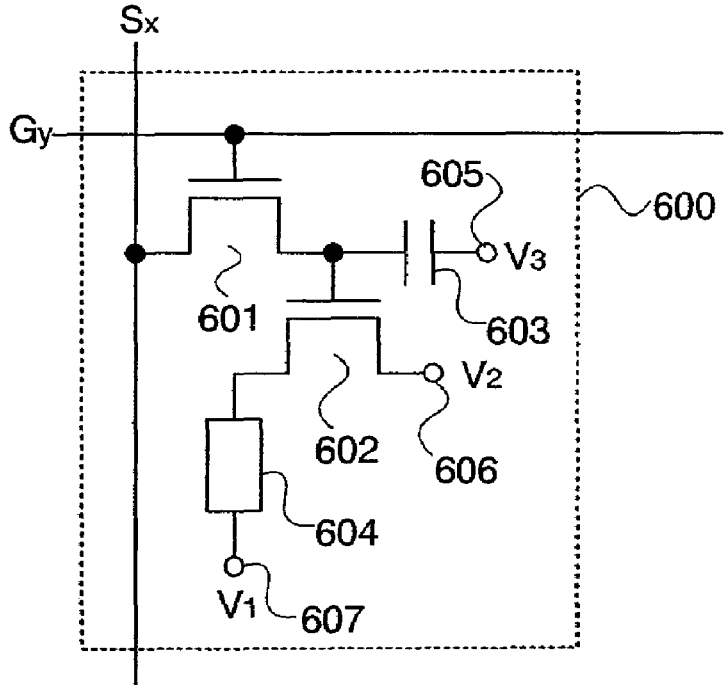

FIG. 6B shows a configuration of the pixel 600 in FIG. 6A. FIG. 6B shows the pixel 600 formed at the intersection of a first signal line $S_x$ (x is a natural number not more than p) among the multiple first signal lines $S_1$ to $S_p$ and a second signal line $G_y$ (y is a natural number not more than q) among the second signal lines $G_1$ to $G_q$. The pixel 600 has a first transistor 601, a second transistor 602, a capacitor 603 and a light-emitting element 604. Note that this embodiment mode illustrates an example where the light-emitting element 604 has a pair of electrodes, and emits light when a current flows between the pair of electrodes. The capacitor 603 may be formed by utilizing the parasitic capacitance of the second transistor 602 or the like. The first transistor 601 and the second transistor 602 may be either n-channel transistors or p-channel transistors. A transistor constituting the pixel 600 may be a thin film transistor.

A gate of the first transistor 601 is connected to the second signal line $G_y$ and one of a source and drain of the first transistor 601 is connected to the first signal line $S_x$ while the other is connected to a gate of the second transistor 602 and one electrode of the capacitor 603. The other electrode of the capacitor 603 is connected to a terminal 605 that receives a potential $V_3$. One of a source and drain of the second transistor 602 is connected to one electrode of the light-emitting element 604 while the other is connected to a terminal 606 that receives a potential $V_2$. The other electrode of the light-emitting element 604 is connected to a terminal 607 that receives a potential $V_1$.

Description is made on a display method of the pixel portion 501 shown in FIGS. 6A and 6B.

In each of the multiple sub-frame periods in one frame period, video signals are inputted to all the pixels 600 in the pixel portion 501. Video signals inputted are digital signals. A method for inputting video signals to all the pixels 600 is described below. While one of the multiple second signal lines $G_1$ to $G_q$ is selected, video signals are inputted to all the multiple first signal lines $S_1$ to $S_p$ In this manner, video signals are inputted to one row of pixels in the pixel portion 501. By sequentially selecting the multiple second signal lines $G_1$ to $G_q$ to perform similar operation, video signals are inputted to all the pixels 600 in the pixel portion 501.

Description is made on the pixel 600, to which a video signal is inputted from a first signal line $S_x$ among the multiple first signal lines $S_1$ to $S_p$ upon selecting a second signal line $G_y$ out of the multiple second signal lines $G_1$ to $G_q$. When the second signal line $G_y$ is selected, the first transistor 601 is turned on. "A transistor is on" means that a source and a drain thereof are electrically connected to each other, while "a transistor is off" means that a source and a drain thereof are not electrically connected to each other. When the first transistor 601 is turned on, a video signal inputted to the first signal line $S_x$ is inputted to the gate of the second transistor 602 through the first transistor 601. The second transistor 602 is selected to be turned on or off in accordance with a video signal inputted to the second transistor 602. When the second transistor 602 is selected to be turned on, a drain current of the second transistor 602 flows into the light-emitting element 604, thereby the light-emitting element 604 emits light.

The potential $V_2$ and the potential $V_3$ are controlled to have a constant potential difference when the second transistor 602 is turned on. The potential $V_2$ and the potential $V_3$ may have same level. If the potential $V_2$ and the potential $V_3$ are set at the same level, the terminal 605 and the terminal 606 may be connected to the same wire. The potential $V_1$ and the potential $V_2$ are set to have a predetermined potential difference when the light-emitting element 604 is selected to emit light. In this manner, a current is supplied to the light-emitting element 604 so that the light-emitting element 604 emits light.

This embodiment mode may be appropriately implemented in combination with any of Embodiment Mode 1 to Embodiment Mode 3.

Embodiment Mode 5

Figure 7A:
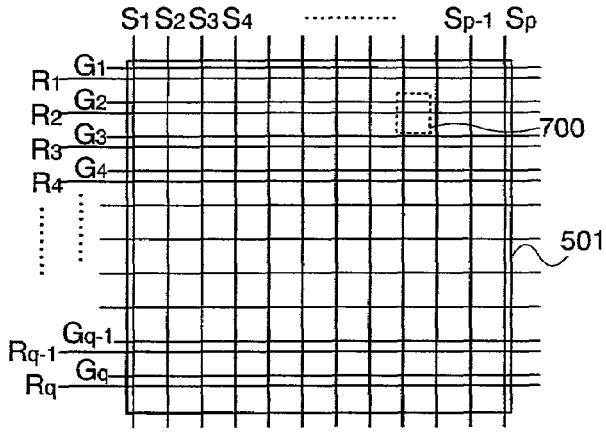
FIGS. 7A to 7C illustrate Embodiment Mode 5.

FIG. 7A shows a configuration example of the pixel portion 501 shown in FIGS. 5A and 5B. FIG. 7A shows a configuration example (hereinafter referred to as a second configuration) that is different from the first configuration shown in Embodiment Mode 4. The pixel portion 501 has multiple first signal lines $S_1$ to $S_p$ (p is a natural number), multiple second signal lines $G_1$ to $G_q$(q is a natural number) that are provided to intersect the multiple first signal lines $S_1$ to $S_q$, multiple third signal lines $R_1$ to $R_q$ that are also provided to intersect the multiple first signal lines $S_1$ to $S_q$, and a pixel 700 provided at each intersection of the first signal lines $S_1$ to $S_p$, the second signal lines $G_1$ to $G_q$, and the third signal lines $R_1$ to $R_q$.

Figure 7B:
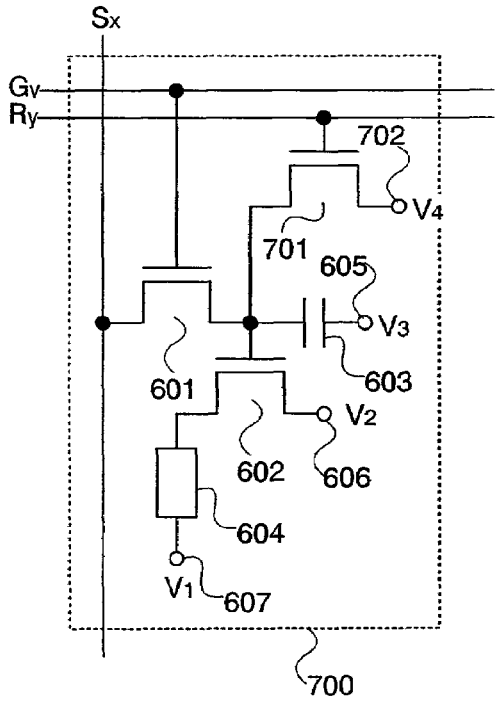

FIG. 7B shows a configuration of the pixel 700 in FIG. 7A. FIG. 7B shows the pixel 700 formed at the intersection of a first signal line $S_x$ (x is a natural number not more than p) among the multiple first signal lines $S_1$ to $S_p$, a second signal line $G_y$ (y is a natural number not more than q) among the multiple second signal lines $G_1$ to $G_q$, and a third signal line $R_y$ among the multiple third signal lines $R_1$ to $R_q$. Note that common portions between FIGS. 6B and 7B are denoted by common reference numerals, and the description thereon is omitted. FIG. 7B is different from the pixel 600 shown in FIG. 6B in that a third transistor 701 is additionally provided. The third transistor 701 may be either an n-channel transistor or a p-channel transistor. A transistor constituting the pixel 700 may be a thin film transistor.

A gate of the third transistor 701 is connected to the third signal line $R_y$, and one of a source and drain of the third transistor 701 is connected to the gate of the second transistor 602 and one electrode of the capacitor 603 while the other is connected to a terminal 702 that receives a potential $V_4$.

Description is made on a display method of the pixel portion 501 shown in FIGS. 7A and 7B.

The method for controlling the light-emitting element 604 to emit light is the same as that described in Embodiment Mode 4. In the pixels having the configurations shown in FIGS. 7A and 7B, the provision of the third signal line $R_y$ and the third transistor 701 enables the light-emitting element 604 in the pixel 700 to emit no light independently of a video signal inputted form the first signal line $S_x$. That is, the light-emission period of the light-emitting element 604 in the pixel 700 can be set in accordance with a signal inputted to the third signal line $R_y$. By sequentially selecting the second signal lines $G_1$ to $G_q$ in this manner, the light-emission period can be set shorter than the selection period of all the second signal lines $G_1$ to $G_q$.

The potential $V_4$ may be set so that the second transistor 602 is turned off when the third transistor 701 is turned on. For example, the potential $V_4$ can be set to have the same level as the potential $V_3$ when the third transistor 701 is turned on. By setting the potential $V_3$ and the potential $V_4$ at the same level, charges held in the capacitor 603 are discharged and a source-gate voltage of the second transistor 602 becomes zero, thereby the second transistor 602 can be turned off. Note that the terminal 605 and the terminal 702 may be connected to the same wire in the case where the potential $V_3$ and the potential $V_4$ are set at the same level.

Note that the position of the third transistor 701 is not limited to that shown in FIG. 7B. For example, the third transistor 701 may be disposed in series with the second transistor 602. In this configuration, by turning off the third transistor 701 by a signal inputted to the third signal line $R_y$, current flowing into the light-emitting element 604 can be shut so that the light-emitting element 604 emits no light.

Figure 7C:
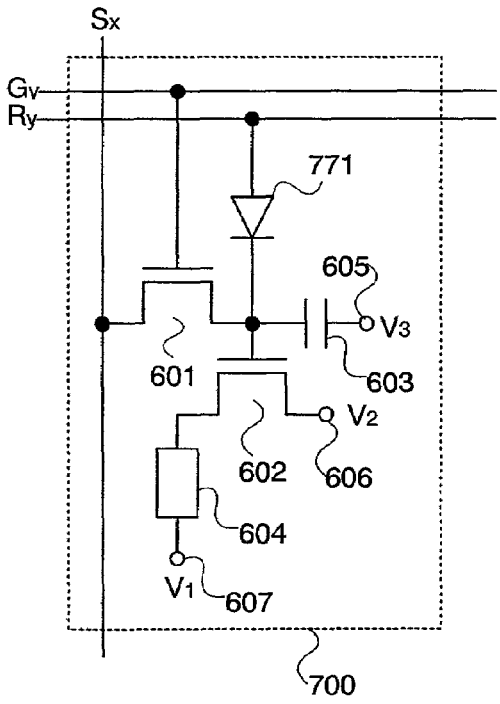

Instead of the third transistor 701 shown in FIG. 7B, a diode may be used. FIG. 7C shows a pixel configuration where a diode 771 is used instead of the third transistor 701. Note that common portions between FIGS. 7B and 7C are denoted by common reference numerals, and the description thereon is omitted. One electrode of the diode 771 is connected to the third signal line $R_y$ while the other is connected to the gate of the second transistor 602 and one electrode of the capacitor 603.

The diode 771 passes current from one electrode thereof to the other electrode. A p-channel transistor is used as the second transistor 602. By increasing a potential of one electrode of the diode 771, a gate potential of the second transistor 602 can be increased to turn off the second transistor 602.

Although FIG. 7C shows a configuration where one electrode of the diode 771 connected to the third signal line $R_y$ passes current to the opposite electrode that is connected to the gate of the second transistor 602, and the second transistor 602 is a p-channel transistor, the invention is not limited to this. The diode 771 may have such a configuration that the electrode connected to the gate of the second transistor 602 passes current to the opposite electrode that is connected to the third signal line $R_y$, and the second transistor 602 is an n-channel transistor. When the second transistor 602 is an n-channel transistor, the second transistor 602 can be turned off by decreasing a potential of one electrode of the diode 771 to decrease the gate potential of the second transistor 602.

The diode 771 may be a diode-connected transistor. The diode-connected transistor is a transistor whose drain and gate are connected to each other. As the diode-connected transistor, either a p-channel transistor or an n-channel transistor may be employed.

This embodiment mode can be appropriately implemented in combination with any of Embodiment Mode 1 to Embodiment Mode 4.

Embodiment 1

Figure 8A:
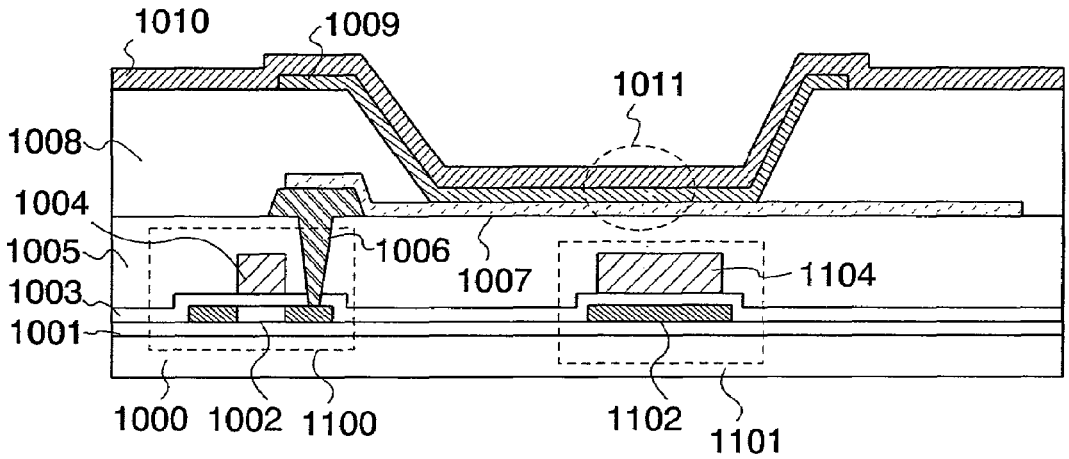
FIGS. 8A and 8B illustrate Embodiment 1.
Figure 8B:
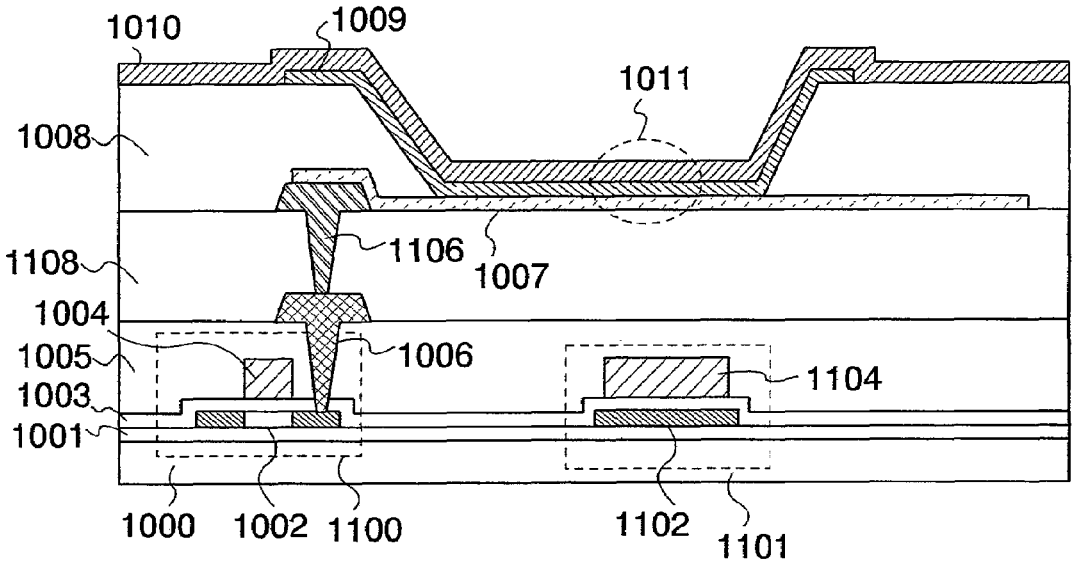

In this embodiment, description is made on an example of actually manufacturing a pixel. FIGS. 8A and 8B are cross-sectional views of a pixel in a panel described in Embodiment Mode 3 to Embodiment Mode 5. Shown here is the example where a TFT is used as a switching element disposed in the pixel and a light-emitting element is used as a display element.

In FIG. 8A and FIG. 8B, reference numeral 1000 denotes a substrate; 1001, a base film; 1002, a semiconductor layer; 1102, a semiconductor layer; 1003, a first insulating film; 1004, a gate electrode; 1104, an electrode; 1005, a second insulating film; 1006, an electrode; 1007, a first electrode; 1008, a third insulating film; 1009, a light-emitting layer; and 1010, a second electrode. Reference numeral 1100 denotes a TFT; 1011, a light-emitting element; and 1101, a capacitor. In FIG. 8A, the TFT 1100 and the capacitor 1101 are shown as typical examples of the elements for forming a pixel. The structure of FIG. 8A is described below.

The substrate 1000 may be a glass substrate such as barium borosilicate glass or alumino borosilicate glass, a quartz substrate, a ceramic substrate or the like, for example. Alternatively, a metal substrate containing stainless steel or a semiconductor substrate having a surface over which an insulating film is formed may be used. Further alternatively, a flexible substrate formed of a synthetic resin such as plastic may be used. The surface of the substrate 1000 may be planarized by polishing such as CMP.

The base film 1001 may be formed by using an insulating film such as silicon oxide, silicon nitride or silicon nitride oxide ($SiO_xN_y$ or $SiN_xO_y$; note that x>y). With the base film 1001, alkaline metals such as Na or alkaline earth metals contained in the substrate 1000 can be prevented from diffusing into the semiconductor layer 1002, which would otherwise cause adverse effects on the characteristics of the TFT 1100. Although the base film 1001 has a single-layer structure in FIGS. 8A and 8B, it may have a multi-layer structure of two or more layers. Note that when the diffusion of impurities is of little concern in the case of using a quartz substrate, for example, the base film 1001 is not necessarily required.

As the semiconductor layer 1002 and the semiconductor layer 1102, a crystalline semiconductor film or an amorphous semiconductor film processed into an arbitrary shape may be used. A crystalline semiconductor film may be obtained by crystallizing an amorphous semiconductor film. As the crystallization method, laser crystallization, thermal crystallization using RTA (Rapid Thermal Anneal) or an annealing furnace, thermal crystallization using metal elements for accelerating crystallization, and the like may be employed. The semiconductor layer 1002 has a channel formation region and a pair of impurity regions doped with impurity elements that impart conductivity. Note that impurity regions doped with a low concentration of the impurity elements than that of the pair of impurity regions may be provided between the channel formation region and the pair of impurity regions respectively. The entire semiconductor layer 1102 can be doped with impurity elements that impart conductivity.

The first insulating film 1003 may be formed by stacking silicon oxide, silicon nitride, silicon nitride oxide or the like, in a single layer or multiple layers.

The gate electrode 1004 and the electrode 1104 may be formed by using one element selected from among Ta, W, Ti, Mo, Al, Cu, Cr and Nd or an alloy or compound containing such elements, in a single layer or multiple layers.

The TFT 1100 is constituted by the semiconductor layer 1002, the gate electrode 1004 and the first insulating film 1003 between the semiconductor layer 1002 and the gate electrode 1004. In FIGS. 8A and 8B, only the TFT 1100 connected to the first electrode 1007 of the light-emitting element 1011 is shown as the TFT for constituting the pixel; however, multiple TFTs may be provided. In addition, although a top-gate transistor is shown as the TFT 1100, the TFT 1100 may be a bottom-gate transistor where a gate electrode is provided below a semiconductor layer as well as a dual-gate transistor where gate electrodes are provided above and below a semiconductor layer.

The capacitor 1101 uses the first insulating film 1003 as a dielectric and has a pair of electrodes, that are the semiconductor layer 1102 and the electrode 1104 facing each other with the first insulating film 1003 interposed therebetween. Note that although FIGS. 8A and 8B show examples of the capacitor in the pixel, where the semiconductor layer 1102 formed concurrently with the semiconductor layer 1002 of the TFT 1100 is used as one of the pair of electrodes, and the electrode 1104 formed concurrently with the gate electrode 1004 of the TFT 1100 is used as the other electrode, the invention is not limited to this.

The second insulating film 1005 may be formed by using an inorganic insulating film or an organic insulating film in a single layer or multiple layers. The inorganic insulating film includes a silicon oxide film formed by CVD, a silicon oxide film formed by SOG (Spin On Glass) or the like, while the organic insulating film includes a film formed of polyimide, polyamide, BCB (benzocyclobutene), acrylic, a positive photosensitive organic resin, or a negative photosensitive organic resin.

Alternatively, the second insulating film 1005 may be formed by using a material having a skeleton composed of silicon (Si) and oxygen (O). As a substituent, an organic group containing at least hydrogen (e.g., an alkyl group or aromatic hydrocarbon) may be used. Alternatively, a fluoro group may be used as the substituent. Further alternatively, both a fluoro group and an organic group containing at least hydrogen may be used as the substituent.

The electrode 1006 may be a film formed by using an element selected from among Al, W, Mo, Ti, Pt, Cu, Ta and Au, or an alloy film containing such elements, in a single layer or multiple layers. Alternatively, the element 1006 may be formed by using an alloy film containing one or more of the aforementioned elements, and one or more of Ni, C and Mn, in a single layer or multiple layers.

One or both of the first electrode 1007 and the second electrode 1010 may be light-transmissive electrode. The light-transmissive electrode may be formed of indium tin oxide (ITO), zinc oxide (ZnO), indium zinc oxide (IZO), gallium-doped zinc oxide (GZO) or other light-transmissive conductive oxide materials. As the light-transmissive conductive oxide material, a mixture of ITO and silicon oxide (hereinafter referred to as ITSO), a mixture of ITO and titanium oxide (hereinafter referred to as ITTO), or a mixture of ITO and molybdenum oxide (hereinafter referred to as ITMO) may be used. Further, as the light-transmitting conductive oxide material, ITO doped with titanium, molybdenum or gallium, or a material obtained by mixing indium oxide containing silicon oxide with 2 to 20 wt % of zinc oxide (ZnO) may be used.

The other of the first electrode 1007 and the second electrode 1010 may be formed by using a material that does not transmit light. For example, it may be formed by using alkaline metals such as Li or Cs, alkaline earth metals such as Mg, Ca or Sr, an alloy containing such metals (e.g., Mg:Ag, Al:Li or Mg:In), a compound of such metals (e.g., $CaF_2$ or calcium nitride), or rare earth metals such as Yb or Er.

The third insulating film 1008 can be formed by using the same material as the second insulating film 1005. The third insulating film 1008 is formed around the first electrode 1007 so as to cover edges of the first electrode 1007, and functions to separate the light-emitting layer 1009 of adjacent pixels.

The light-emitting layer 1009 is formed in a single layer or multiple layers. When the light-emitting layer 1009 is formed in multiple layers, these layers may be classified into a hole injection layer, a hole transporting layer, a light-emitting layer, an electron transporting layer, an electron injection layer and the like in terms of the carrier transporting properties. Note that the boundary between each layer is not necessarily distinct, and there may be a case where the boundary cannot be distinguished clearly because a material for forming each layer is partially mixed with each other. Each layer may be formed by using an organic material or an inorganic material. The organic material may be any of a high molecular weight material, a medium molecular weight material and a low molecular weight material.

The light-emitting element 1011 is constituted by the light-emitting layer 1009, and the first electrode 1007 and the second electrode 1010 overlapping each other with the light-emitting layer 1009 interposed therebetween. One of the first electrode 1007 and the second electrode 1010 corresponds to an anode while the other corresponds to a cathode. The light-emitting layer 1011 emits light when a current flows from the anode to the cathode upon application of a forward voltage that is higher than the threshold voltage between the anode and the cathode.

The configuration of FIG. 8B is described below. Note that common portions between FIGS. 8A and 8B are denoted by common reference numerals, and the description thereon is omitted.

FIG. 8B shows a structure where an insulating film 1108 is provided between the second insulating film 1005 and the third insulating film 1008 in FIG. 8A. The electrode 1006 and the first electrode 1007 are connected to each other by the electrode 1106 in a contact hole provided in the insulating film 1108.

The insulating film 1108 may have a similar structure to the second insulating film 1105. The electrode 1106 may have a similar structure to the electrode 1006.

This embodiment can be appropriately implemented in combination with embodiment modes of the invention.

Embodiment 2

Figure 9A:
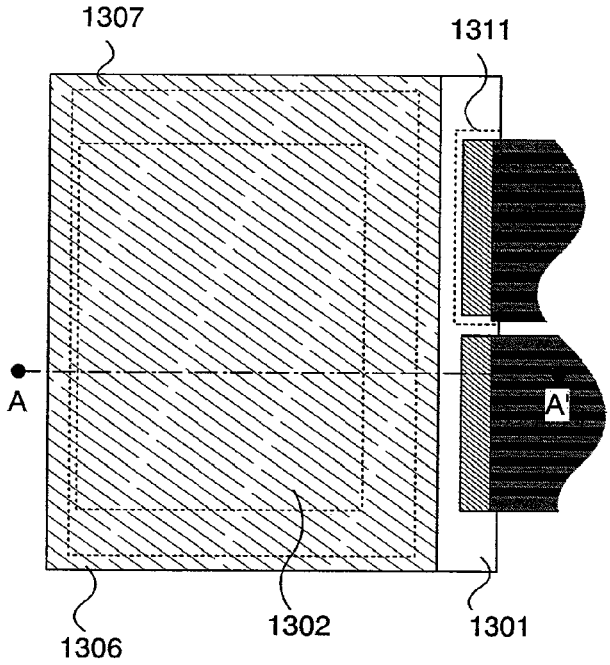
FIGS. 9A to 9C illustrate Embodiment 2.
Figure 9B:
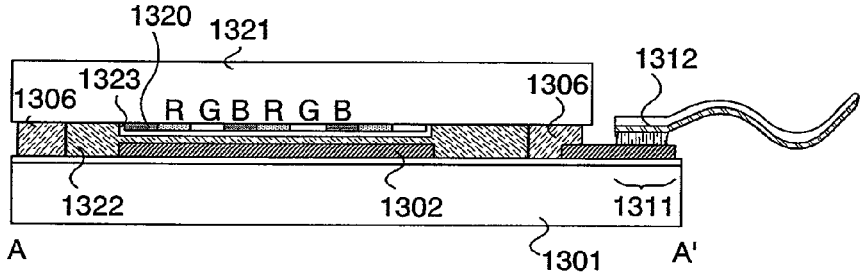
Figure 9C:
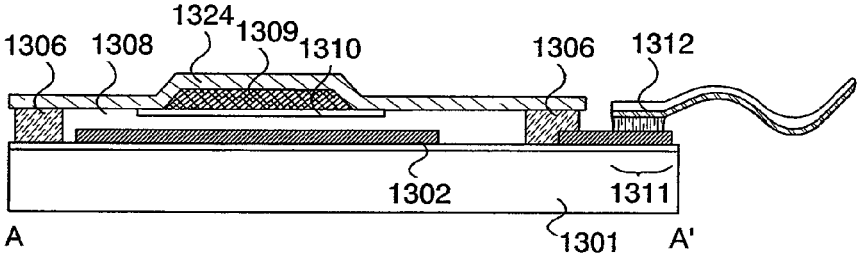

In this embodiment, description is made with reference to FIGS. 9A to 9C on structures of a sealed substrate over which pixels are formed. FIG. 9A is a top view of a panel formed by sealing a substrate over which pixels are formed, and FIGS. 9B and 9C are cross-sectional views along A-A' in FIG. 9A. FIGS. 9B and 9C show examples of a different sealing method.

In FIGS. 9A to 9C, a pixel portion 1302 having multiple pixels is disposed over a substrate 1301, and a sealant 1306 is provided so as to surround the pixel portion 1302 while a sealant 1307 is attached thereto. The pixels may have the structures shown in Embodiment modes of the invention or Embodiment 1.

In the display panel shown in FIG. 9B, the sealant 1307 in FIG. 9A corresponds to a counter substrate 1321. The light-transmissive counter substrate 1321 is attached by using the sealant 1306 as an adhesive, and a hermetically sealed space 1322 is formed by the substrate 1301, the counter substrate 1321 and the sealant 1306. The counter substrate 1321 is provided with a color filter 1320 and a protective film 1323 for protecting the color filter. Light emitted from the light-emitting element that is disposed in the pixel portion 1302 is emitted to the outside through the color filter 1320. The hermetically sealed space 1322 is filled with an inert resin, liquid or the like. Note that the resin for filling the hermetically sealed space 1322 may be a light-transmissive resin in which a moisture absorbent is dispersed. In addition, the same material may be used for the sealant 1306 and the material for filling the hermetically sealed space 1322, so that the adhesion of the counter substrate 1321 may be performed concurrently with the sealing of the pixel portion 1302.

In the display panel shown in FIG. 9C, the sealant 1307 in FIG. 9A corresponds to a sealant 1324. The sealant 1324 is attached with the sealant 1306 as an adhesive, so that a hermetically sealed space 1308 is formed by the substrate 1301, the sealant 1306 and the sealant 1324. The sealant 1324 is provided with a moisture absorbent 1309 in its depression in advance, and functions to keep a clean atmosphere by adsorbing moisture, oxygen or the like in the hermetically sealed space 1308, thereby suppressing the degradation of light-emitting elements. This depression is covered with a meshed cover material 1310. The cover material 1310 transmits air and moisture, whereas the moisture absorbent 1309 does not transmit them. The hermetically sealed space 1308 may be filled with a rare gas such as a nitrogen gas or an argon gas, or may be filled with an inert resin or liquid as well.

On the substrate 1301, an input terminal portion 1311 for transmitting signals to the pixel portion 1302 and the like are provided, and the input terminal portion 1311 receives signals such as video signals through an FPC (Flexible Printed Circuit) 1312. The input terminal portion 1311 electrically connects wires formed over the substrate 1301 to wires provided in the FPC 1312 by using a resin in which a conductor is dispersed (anisotropic conductive rein: ACF).

A driver circuit for inputting signals to the pixel portion 1302 may be formed over the substrate 1301 having the pixel portion 1302. Alternatively, the driver circuit for inputting signals to the pixel portion 1302 may be formed in an IC chip, which may be connected onto the substrate 1301 by COG (Chip On Glass) bonding, TAB (Tape Automated Bonding), or by using a printed wiring board.

This embodiment can be appropriately implemented in combination with any of embodiment modes of the invention and Embodiment 1.

Embodiment 3

The invention can be applied to a display module in which a circuit for inputting signals to a panel is mounted on the panel.

Figure 10:
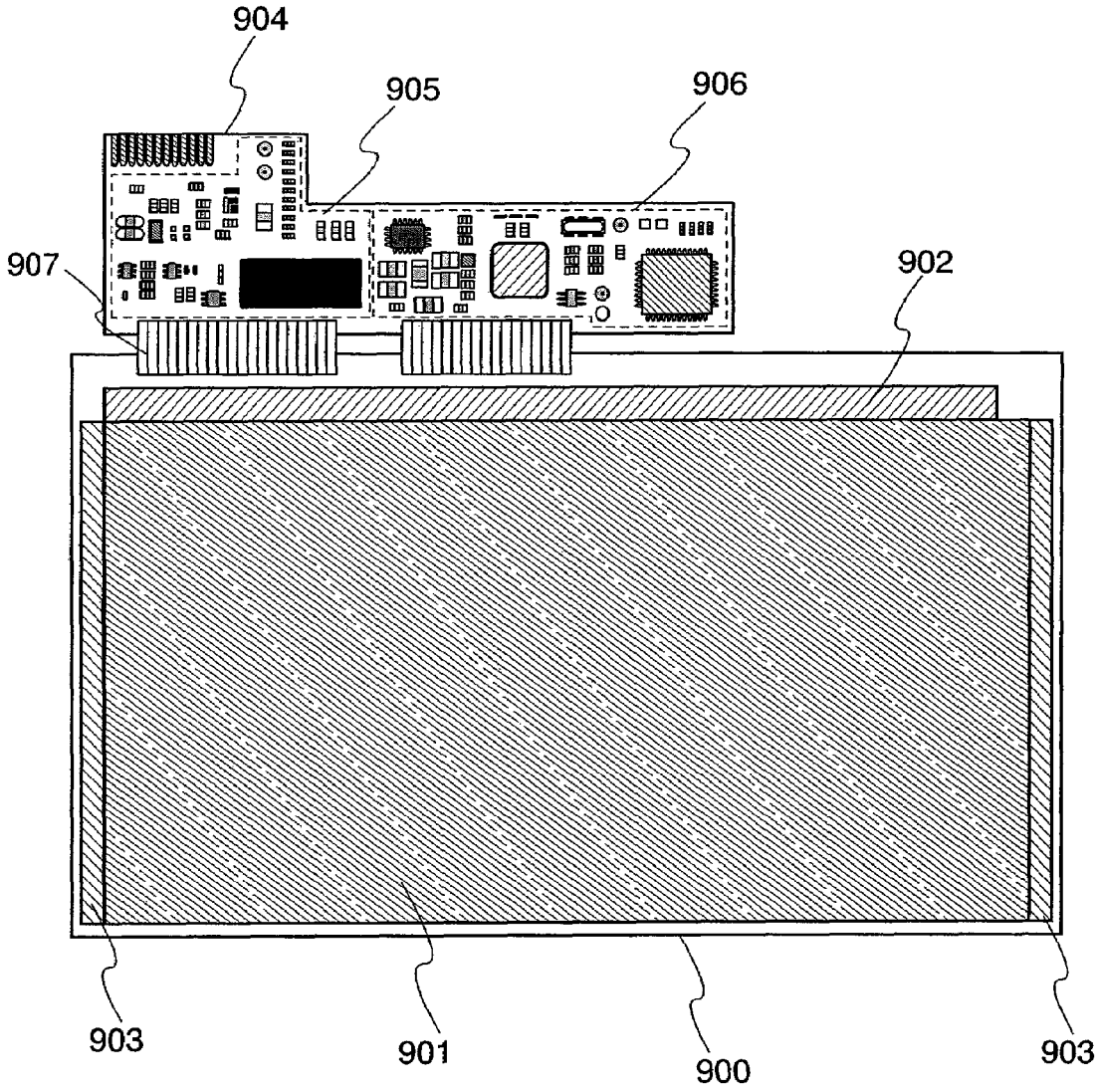
FIG. 10 illustrates Embodiment 3.

FIG. 10 shows a display module in which a panel 900 and a circuit board 904 are combined. FIG. 10 shows an example where a controller 905, a signal divider circuit 906 and the like are formed over the circuit board 904. However, the circuits formed over the circuit board 904 are not limited to these. Any circuits that generate signals for controlling the panel may be formed.

Signals outputted from these circuits formed over the circuit board 904 are inputted to the panel 900 through a connecting wire 907.

The panel 900 has a pixel portion 901, a first driver circuit 902 and a second driver circuit 903. The structure of the panel 900 may be similar to those shown in Embodiment 1, Embodiment 2 and the like. In the example shown in FIG. 10, the first driver circuit 902 and the second driver circuit 903 are formed over the same substrate as the pixel portion 901. However, the display module of the invention is not limited to this. For example, only the second driver circuit 903 may be formed over the same substrate as the pixel portion 901 while the first driver circuit 902 may be formed over the circuit board. Alternatively, both of the first driver circuit 902 and the second driver circuit 903 may be formed over the circuit board.

Display portions of various electronic appliances can be formed by incorporating such a display module.

This embodiment can be appropriately implemented in combination with any of embodiment modes of the invention, Embodiment 1 and Embodiment 2.

Embodiment 4

The invention can be applied to various electronic appliances such as a camera (e.g., a video camera or a digital camera), a projector, a head mounted display (goggle display), a navigation system, a car stereo, a personal computer, a game machine, a portable information terminal (e.g., a mobile computer, a portable phone set or an electronic book), an image reproducing device provided with a recording medium (specifically, a device for reproducing a recording medium such as a digital versatile disc (DVD) and having a display for displaying the reproduced image) and the like. FIGS. 11A to 11D show examples of such electronic appliances.

Figure 11A:
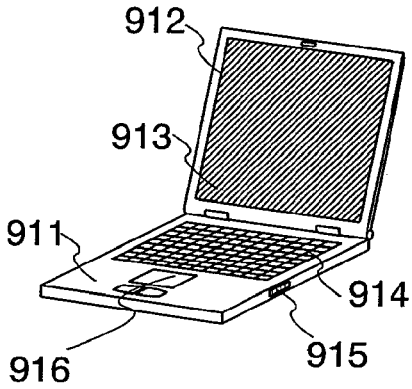
FIGS. 11A to 11D illustrate Embodiment 4.

FIG. 11A shows a laptop personal computer, which includes a main body 911, a housing 912, a display portion 913, a keyboard 914, an external connecting port 915, a pointing mouse 916 and the like. The invention can be applied to the display portion 913. By using the invention, the display portion can be downsized and favorable image display can be performed.

Figure 11B:
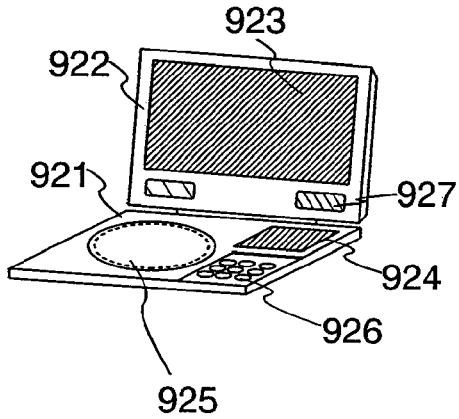
Figure 11C:
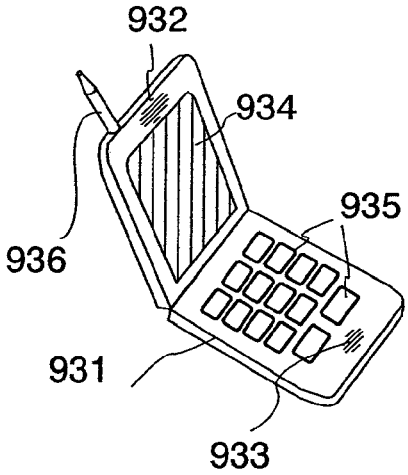
Figure 11D:
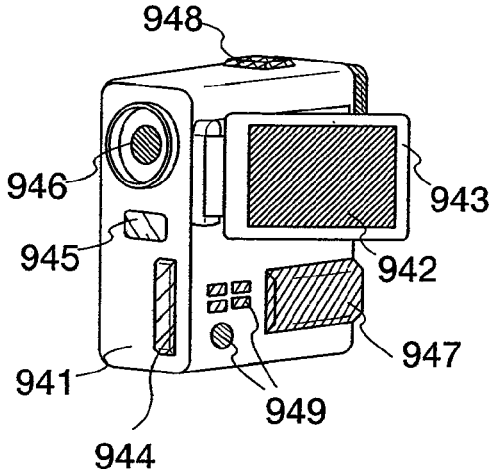

FIG. 11B shows an image reproducing device provided with a recording medium (specifically, a DVD reproducing device) provided with a recording medium, which includes a main body 921, a housing 922, a first display portion 923, a second display portion 924, a recording medium (DVD) reading portion 925, operating keys 926, a speaker portion 927 and the like. The first display portion 923 mainly displays image data while the second display portion 924 mainly displays text data. The invention can be applied to the first display portion 923 and the second display portion 924. By using the invention, the display portion can be downsized and favorable image display can be performed.

FIG. 10C shows a portable phone set, which includes a main body 931, an audio output portion 932, an audio input portion 933, a display portion 934, operating switches 935, an antenna 936 and the like. The invention can be applied to the display portion 934. By using the invention, the display portion can be downsized and favorable image display can be performed.

FIG. 10D shows a camera, which includes a main body 941, a display portion 942, a housing 943, an external connecting port 944, a remote controller receiving portion 945, an image receiving portion 946, a battery 947, an audio input portion 948, operating keys 949, and the like. The invention can be applied to the display portion 942. By using the invention, the display portion can be downsized and favorable image display can be performed.

This embodiment can be appropriately implemented in combination with any of embodiment modes of the invention, Embodiment 1 and Embodiment 3.

The present application is based on Japanese Priority application No. 2005-024547 filed on Jan. 31, 2005 with the Japanese Patent Office, the entire contents of which are hereby incorporated by reference.

What is claimed is:

1. A driving method of a method of a display device comprising:

dividing each of a first frame period and a second frame period into m groups, with each of the m groups having a first period and a second period, wherein m is natural number not less than 2;

in the first frame period, writing a first video signal in a first memory area of a first memory in the first period of at least one of the m groups using a controller, wherein the first video signal is stored in a second memory;

in the first frame period, reading a second video signal from a second memory area of the first memory in the second period of at least one of the m groups using the controller, wherein the second video signal is written in a third memory;

in the second frame period, reading the first video signal from the first memory area of the first memory in the second period of at least one of the m groups using the controller, wherein the first video signal is written in the third memory; and in the second frame period, writing a third video signal in the second memory area of the first memory in the first period of at least one of the m groups using the controller, wherein the third video signal is stored in the second memory, wherein, in the first frame period, only writing of the first video signal is performed in the first memory area and only reading of the second video signal is performed in the second memory area, wherein, in the second frame period, only reading of the first video signal is performed in the first memory area and only writing of the third video signal is performed in the second memory area, wherein the first video signal or the third video signal stored in the second memory is written in the first memory in the first period of at least one of the m groups, and wherein the first video signal or the second video signal stored in the first memory is written in the third memory in the second period of at least one of the m groups.

2. The driving method of a display device according to claim 1, wherein, in the second frame period, the number of read operations of the first video signal from the first memory area of the first memory is larger than the number of write operations of the third video signal in the second memory area of the first memory.

3. The driving method of a display device according to claim 1, wherein the first memory area has a first memory capacity to store the first video signal corresponding to a plurality of pixels, wherein the second memory area has a second memory capacity to store the second video signal corresponding to the plurality of pixels, and wherein the first video signal and the second video signal are video signals corresponding to different frame periods.

4. The driving method of a display device according to claim 3, wherein each of the plurality of pixels has a light-emitting element.

5. The driving method of a display device according to claim 1, wherein the second period is longer than the first period.

6. The driving method of a display device according to claim 1, wherein the first memory is an SRAM.

7. The driving method of a display device according to claim 1, wherein the first memory is a single-port memory.

8. The driving method of a display device according to claim 1, further comprising:

dividing each of the first period and the second frame period into n sub-frame periods, wherein n is a natural number not less than 2; and synchronizing start timing of reading the second video signal from the second memory area with start timing of each of the n sub-frame periods.

9. The driving method of a display device according to claim 1, wherein the controller comprises a selector.

10. A driving method of a display device comprising:

dividing each of a first frame period and a second frame period into m groups, with each of the m groups having a first period and a second period, wherein m is a natural number not less than 2;

in the first frame period, writing a first video signal into a first memory area of a first memory in the first period of at least one of the m groups through a bus, wherein the first video signal is stored in a second memory;

in the first frame period, reading a second video signal from a second memory area of the first memory in the second period of at least one of the m groups through the bus, wherein the second video signal is written in a third memory;

in the second frame period, reading the first video signal from the first memory area of the memory in the second period of at least one of the m groups through the bus, wherein the second video signal is written in the third memory; and in the second frame period, writing a third video signal the second memory area of the first memory in the first period of at least one of the m groups through the bus, wherein the third video signal is stored in the second memory, wherein, in the first frame period, only writing of the first video signal is performed in the first memory area and only reading of the second video signal is performed in the second memory area, wherein, in the second frame period, only reading of the first video signal is performed in the first memory area and only writing of the third video signal performed in the second memory area, wherein the first video signal or the third video signal stored in the second memory is written in the first memory in the first period of at least one of the m groups, and wherein the first video signal or the second video signal stored in the memory is written in the third memory in the second period of at least one of the m groups.

11. The driving method of a display device according to claim 10, wherein, in the second frame period, the number of read operations of the first video signal from the first memory area of the first memory is larger than the number of write operations of the third video signal in the second memory area of the first memory.

12. The driving method of a display device according to claim 10, wherein the first memory area has a first memory capacity to store the first video signal corresponding to a plurality of pixels, wherein the second memory area has a second memory capacity to store the second video signal corresponding to the plurality of pixels, and wherein the first video signal and the second video signal are video signals corresponding to different frame periods.

13. The driving method of a display device according to claim 12, Wherein each of the plurality of pixels has a light-emitting element.

14. The driving method of a display device according to claim 10, wherein the second period is longer than the first period.

15. The driving method of a display device according to claim 10, wherein the first memory is an SRAM.

16. The driving method of a display device according to claim 10, wherein the first memory is a single-port memory.

17. The driving method of a display device according to claim 10, further comprising:

dividing each of the first framed period and the second framed period into n sub-framed periods, where n is a natural number not less than 2; and synchronizing start timing of reading the second video signal from the second memory with start timing of each of the n sub-frame periods.

18. The driving method of a display device according to claim 10, wherein the bus connects the first memory and a selector.

* * * * *